US010466634B2

(12) United States Patent
Yamauchi et al.

(10) Patent No.: US 10,466,634 B2
(45) Date of Patent: Nov. 5, 2019

(54) IMAGE FORMING APPARATUS INCLUDING DEVELOPER CARRYING MEMBER

(71) Applicant: CANON KABUSHIKI KAISHA, Tokyo (JP)

(72) Inventors: Hisashi Yamauchi, Numazu (JP); Masataka Mochizuki, Mishima (JP); Norihito Naito, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/140,659

(22) Filed: Sep. 25, 2018

(65) Prior Publication Data

US 2019/0101855 A1 Apr. 4, 2019

(30) Foreign Application Priority Data

Sep. 29, 2017 (JP) ..... 2017-190400

(51) Int. Cl.

| | |
|---|---|
| ***G03G 21/00*** | (2006.01) |
| ***G03G 15/00*** | (2006.01) |
| ***G03G 9/08*** | (2006.01) |
| ***G03G 21/18*** | (2006.01) |

(52) U.S. Cl.

CPC ..... *G03G 15/5008* (2013.01); *G03G 9/08* (2013.01); *G03G 21/0011* (2013.01); *G03G 21/1803* (2013.01); *G03G 2215/00075* (2013.01)

(58) Field of Classification Search

CPC .. G03G 9/08; G03G 15/5008; G03G 21/0005; G03G 21/0011; G03G 21/0041; G03G 21/1803; G03G 2215/00075

See application file for complete search history.

(56) References Cited

U.S. PATENT DOCUMENTS

| | | | | |
|---|---|---|---|---|
| 2012/0008974 | A1* | 1/2012 | Kawai | G03G 15/0806 399/71 |
| 2014/0348556 | A1* | 11/2014 | Baba | G03G 15/081 399/284 |
| 2016/0291523 | A1* | 10/2016 | Noguchi | G03G 21/0005 |
| 2019/0064717 | A1* | 2/2019 | Soda | G03G 15/5008 |

FOREIGN PATENT DOCUMENTS

JP H04245285 A 9/1992

* cited by examiner

*Primary Examiner* — Sophia S Chen

(74) *Attorney, Agent, or Firm* — Rossi, Kimms & McDowell LLP

(57) ABSTRACT

An image forming apparatus includes: an image bearing member; a developer carrying member configured to contact with the image bearing member and to be separated from the image bearing member; a control unit for controlling the image bearing member and the developer carrying member; and a contact member disposed in contact with the image bearing member. The control unit is configured to sequentially execute: (1) rotating the image bearing member at a first speed in a separated state; (2) switching the image bearing member and the developer carrying member from the separated state to a contact state in a state in which the image bearing member rotates at the first speed; and (3) rotating the image bearing member by decreasing a rotation speed of the image bearing member from the first speed to a second speed smaller than the first speed in the contact state.

18 Claims, 7 Drawing Sheets

IMAGE FORMING APPARATUS INCLUDING DEVELOPER CARRYING MEMBER

BACKGROUND OF THE INVENTION

Field of the Invention

The present invention relates to an image forming apparatus, such as an electrophotographic copying machine and an electrophotographic printer.

Description of the Related Art

Conventionally, in image forming apparatus using electrophotographic technology, a toner image formed on a photosensitive drum is transferred to a recording medium, so that an image is formed on the recording medium. Some such image forming apparatus are provided with a cleaning apparatus configured to collect residual toner remaining on the photosensitive drum after the toner image is transferred. The cleaning apparatus includes a cleaning member as a contact member configured to remove residual toner on the photosensitive drum, a collection container configured to store the residual toner therein, and a collection sheet member configured to prevent the residual toner in the collection container from leaking to the outside of the collection container.

Conventionally, "abnormal noise" may be generated from the cleaning apparatus. Abnormal noise is caused when consumption of a photosensitive drum and a developing apparatus progresses and the friction coefficient μ of the surface of the photosensitive drum increases. If the friction coefficient μ of the surface of the photosensitive drum increases, the cleaning member easily causes stick-slip, and when vibration of the cleaning member is transferred to the collection container, the vibration resonates with the natural frequency of the collection container to generate abnormal noise. The stick-slip as used herein refers to self-excited vibration caused when friction surfaces repeatedly adhere and slide on each other. To suppress abnormal noise, the friction coefficient μ of the surface of the photosensitive drum needs to be maintained low until the life of the photosensitive drum reaches the last stage since the start of the use of the photosensitive drum.

The generation of such abnormal noise is undesirable for users who use image forming apparatus in office environments. In Japanese Patent Application Publication No. H04-245285, a coating layer containing lubricant particles is provided at a part of a collection sheet member that contacts with a photosensitive drum. In this manner, the lubricant particles are supplied from the collection sheet to the surface of the photosensitive drum to decrease the friction coefficient μ of the surface of the photosensitive drum. By decreasing the friction coefficient μ of the surface of the photosensitive drum, abnormal noise caused due to vibration of a cleaning member is suppressed.

SUMMARY OF THE INVENTION

However, in the invention disclosed in Japanese Patent Application Publication No. H04-245285, the work of forming the coating layer containing lubricant particles is necessary, and the material cost of the lubricant particles is high, and hence the production cost of the image forming apparatus increases. It is therefore an object of the present invention to provide a technology for reducing abnormal noise caused by vibration of a cleaning member without increasing cost of an image forming apparatus.

In order to achieve the above-mentioned object, an image forming apparatus of the present invention includes:

an image bearing member;

a developer carrying member configured to carry a developer and be able to take a contact state in which the developer carrying member contacts with the image bearing member and a separated state in which the developer carrying member is separated from the image bearing member;

a control unit configured to control the image bearing member and the developer carrying member; and a contact member disposed in contact with a surface of the image bearing member, wherein the control unit is configured to sequentially execute:

(1) rotating the image bearing member at a first speed in the separated state;

(2) switching from the separated state to the contact state when the image bearing member rotates at the first speed; and (3) rotating the image bearing member by decreasing a rotation speed of the image bearing member from the first speed to a second speed smaller than the first speed in the contact state, in order to rotate the image bearing member at the second speed in the contact state.

In order to achieve the above-mentioned object, an image forming apparatus of the present invention includes:

an image bearing member;

a developer carrying member configured to carry a developer and be able to take a contact state in which the developer carrying member contacts with the image bearing member and a separated state in which the developer carrying member is separated from the image bearing member;

a control unit configured to control the image bearing member and the developer carrying member; and a contact member disposed in contact with a surface of the image bearing member, wherein the control unit is configured to sequentially execute:

(1) rotating, when the image bearing member is rotated at a first speed in the contact state, the image bearing member at a second speed higher than the first speed by implementing switching from the first speed to the second speed in contact state; and (2) switching from the contact state to the separated state when the image bearing member rotates at the second speed in the contact state, in order to switch from the contact state to the separated state when the image bearing member is rotated at the first speed.

According to the present invention, abnormal noise caused by vibration of the cleaning member can be reduced.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

EXAMPLE 1

In Example 1, the movement speed of an image bearing member before and after a developer supply period during which a developer carrying member is brought into contact with the image bearing member in order to supply a developer from the developer carrying member to the image bearing member is set to be higher than the movement speed of the image bearing member in the developer supply period. In this manner, stick-slip of a cleaning member can be suppressed, and as a result, the vibration of a collection container is suppressed to reduce the occurrence of abnormal noise.

Figure 1:
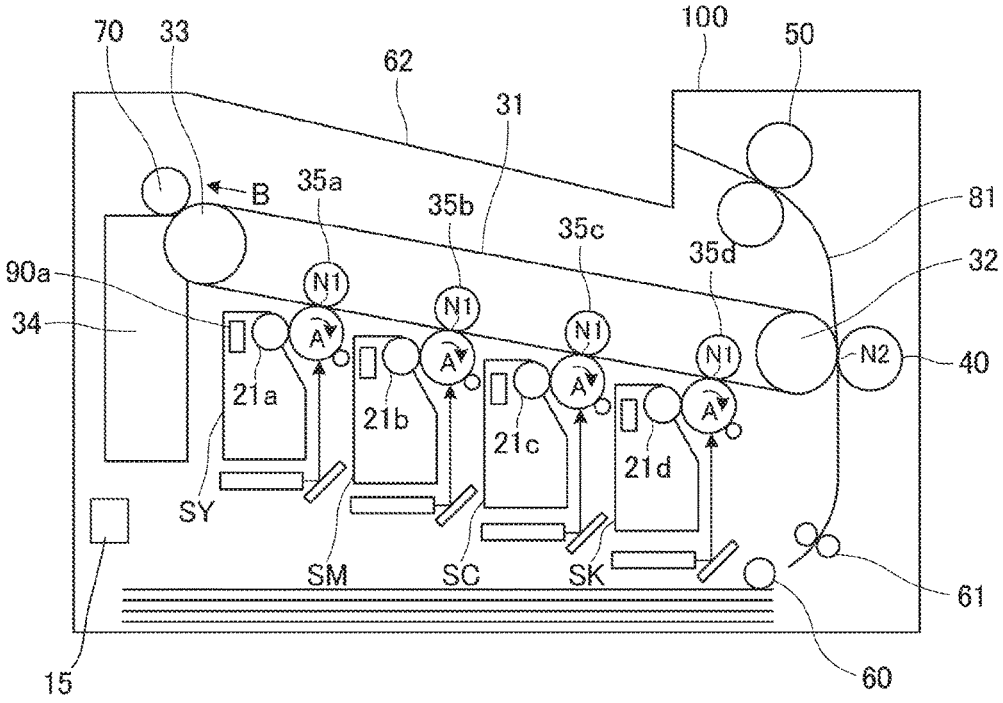
FIG. 1 is a schematic cross-sectional view of an image forming apparatus according to Example 1.

FIG. 1 is a schematic cross-sectional view of an image forming apparatus according to Example 1. Referring to FIG. 1, the overall configuration of an electrophotographic image forming apparatus (hereinafter referred to as "image forming apparatus") is described. An image forming apparatus 100 is a full-color laser beam printer employing an in-line system and an intermediate transfer system. The image forming apparatus 100 can form full-color images on recording media (for example, recording sheet, plastic sheet, and cloth) in accordance with image information.

Image information is input to an apparatus main body of the image forming apparatus 100 from an image reading apparatus connected to the apparatus main body of the image forming apparatus 100 or a host device such as a personal computer communicably connected to the apparatus main body of the image forming apparatus 100. The image forming apparatus 100 has process cartridges S as a plurality of image forming units. In this example, the image forming apparatus 100 has four process cartridges SY to SK for forming images of colors of yellow (Y), magenta (M), cyan(C), and black (K), respectively. In this example, the process cartridges SY to SK have the same configuration except for colors of toner contained therein. Thus, unless otherwise specified, the suffixes Y to K are omitted, and the process cartridges SY to SK are collectively described. It should be understood that the process cartridges may have different shapes and different sizes.

In this example, the process cartridges SY to SK are arranged in the image forming apparatus 100 side by side. The process cartridges S are removably mounted to the image forming apparatus 100 through mounting portion such as a mount guide (not shown) and a positioning member (not shown) provided in the apparatus main body of the image forming apparatus 100. Note that, in this example, the process cartridges S are removable mounted to the image forming apparatus 100, but a developing unit (developing apparatus), a photosensitive unit, and a cleaning apparatus may be individually removably mounted to the apparatus main body of the image forming apparatus 100. A photosensitive drum 10 (image bearing member) serving as a rotating member is rotationally driven by drive portion (not shown). A scanner unit (not shown) is disposed in the image forming apparatus 100. The scanner unit 13 forms an electrostatic latent image on the photosensitive drum 10 (image bearing member) through laser irradiation based on image information. Exposure by laser is performed in a main scanning direction (direction orthogonal to transporting direction of recording medium) for each scanning line on the basis of a BD signal. On the other hand, exposure by laser is performed in a sub-scanning direction (transporting direction of recording medium) with a delay of a predetermined period from a TOP signal starting from a switch (not shown) in a sheet transportation path (not shown). In this manner, in the four process cartridges SY to SK, the same positions on the photosensitive drums 10 can be always exposed with laser.

An intermediate transfer belt 31 for transferring a toner image (developer image) on the photosensitive drum 10 onto a recording medium 81 is disposed in the image forming apparatus 100 so as to be opposed to the photosensitive drum 10. The intermediate transfer belt 31, which is an endless belt, cyclically moves in the direction of arrow B in FIG. 1 while contacting with the photosensitive drum 10. On the inner circumferential surface side of the intermediate transfer belt 31, four primary transfer rollers 35 (35*a* to 35*d*) serving as primary transfer portion are disposed so as to be opposed to the four photosensitive drums 10, respectively. The intermediate transfer belt cyclically moves at substantially the same circumferential speed of the photosensitive drum.

The primary transfer roller 35 is applied with a bias of charging polarity opposite to regular charging polarity of toner from a primary transfer bias power source (not shown) serving as primary transfer bias application unit. The regular charging polarity of toner refers to the polarity of toner used for development. In this example, toner having negative polarity is toner having regular charging polarity. In this manner, a toner image on the photosensitive drum 10 is transferred (primarily transferred) onto the intermediate transfer belt 31. A secondary transfer roller 40 serving as secondary transfer portion is disposed on the outer circumferential surface side of the intermediate transfer belt 31. The secondary transfer roller 40 is applied with a bias of charging polarity opposite to the regular charging polarity of toner from a secondary transfer bias power source (not shown) serving as secondary transfer bias application unit. In this manner, a toner image on the intermediate transfer belt 31 is transferred (secondarily transferred) onto the recording medium 81. For example, when a full-color image is formed, the above-mentioned process is sequentially performed in the process cartridges SY to SK, and toner images of respective colors are sequentially overlapped on the intermediate transfer belt 31.

In synchronization with the movement of the intermediate transfer belt 31, the recording medium 81 is transported to a secondary transfer region that is a nip between the intermediate transfer belt 31 and the secondary transfer roller 40. Toner image of four colors on the intermediate transfer belt 31 are secondarily transferred onto the recording medium 81 by a secondary transfer roller 40 that contacts with the intermediate transfer belt 31 through the recording medium 81. The recording medium 81 having the toner images transferred thereon is thereafter transported to a fixing apparatus 50 serving as fixing portion. The recording medium 81 having the toner images transferred thereon is heated by the fixing apparatus 50 and pressurized, so that the toner images are fixed on the recording medium 81.

In this example, the image forming apparatus 100 has printing modes of three printing speeds, which are 45 ppm, 30 ppm, and 15 ppm. ppm refers to the page-per-minute, which indicates how many sheets are printed per minute. The peripheral speeds of the photosensitive drum in these cases are 214 mm/s, 143 mm/s, and 71 mm/s in descending order of printing speed. Specifically, 45 ppm corresponds to 214 mm/s. The reason why the image forming apparatus 100 has a plurality of printing speeds as described above is that the amount of heat necessary for fixing a toner image differs depending on the thickness of a recording medium. Specifically, a larger amount of heat is necessary for fixing a thick recording medium as compared with a thin recording medium, and it is therefore necessary to secure the amount of heat for fixing a toner image by decreasing the transportation speed of paper. Note that, in this example, the basis weight of a recording medium that can be printed at 45 ppm is 60 $g/m^2$ to 80 $g/m^2$, the basis weight of a recording medium that can be printed at 30 ppm is 80 $g/m^2$ to 110 $g/m^2$, and the basis weight of a recording medium that can be printed at 15 ppm is 110 $g/m^2$ to 200 $g/m^2$.

<Process Cartridge>

Figure 2:
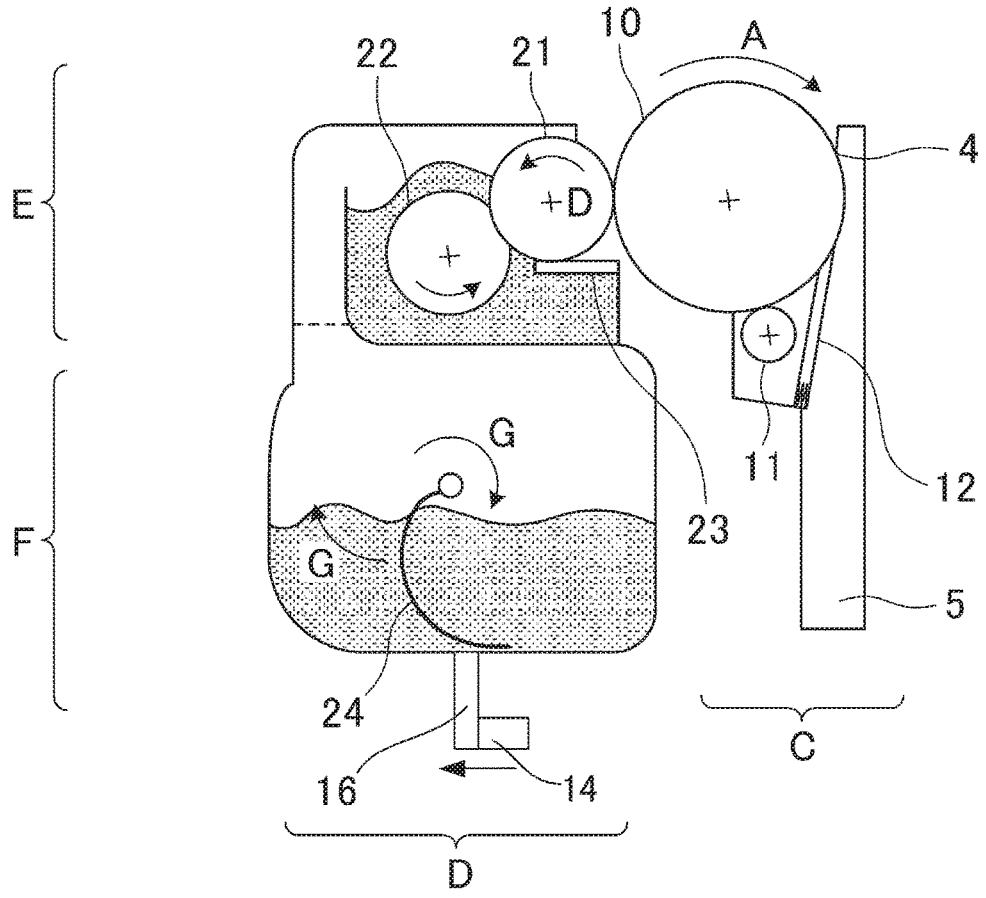
FIG. 2 is a schematic cross-sectional view of a process cartridge according to Example 1.

FIG. 2 is a schematic cross-sectional view of the process cartridge according to Example 1. Next, the overall configuration of the process cartridge according to this example is described with reference to FIG. 2. Note that the relation between driving speeds and driving timings of the photosensitive drum and the developing roller and the operation of contact and separation of the photosensitive drum and the developing roller is characteristic of this example, and is thus described later in detail. The process cartridge S includes a photosensitive unit C having the photosensitive drum 10 and the like and a developing unit (developing apparatus) D having a developing roller 21 (developer carrying member) and the like. The photosensitive unit C includes a cleaning member 12 configured to remove residual toner remaining on the photosensitive drum 10, the collection sheet member 4, the collection container 5, the charging roller 11, and the photosensitive drum 10. The charging roller 11, the cleaning member 12, and the collection sheet member 4 are disposed so as to contact with the photosensitive drum 10. A frame of the developing unit D is provided with a portion to be pressed 16. When a pressing portion 14 provided in the apparatus main body of the image forming apparatus presses the portion to be pressed 16, the developing roller 21 located on the side opposite to the portion to be pressed 16 across a swinging center of the developing unit D moves to a position that contacts with the photosensitive drum 10. When the pressing state of the pressing portion 14 by the portion to be pressed 16 is released, the developing unit D is turned such that the developing roller 21 is separated away from the photosensitive drum 10 due to biasing force of biasing portion (not shown). In other words, a contact/separation mechanism of the present invention is configured to switch between the contact state and the separated state by moving the developing roller 21. The operation of the pressing portion 14 (movement to the position to press the portion to be pressed 16 and the position not to press the portion to be pressed 16) is controlled by the control unit 15 provided in the apparatus main body. Note that the contact/separation mechanism for the developing roller 21 and the photosensitive drum 10 is not limited to the above-mentioned configuration, and other conventionally known configurations may be used.

The photosensitive drum 10 is rotatably mounted to the photosensitive unit C through a bearing (not shown). When receiving driving power from a driving motor (not shown), the photosensitive drum 10 is rotationally driven in the direction of arrow A in FIG. 2 in accordance with the image forming operation. The charging roller 11 is applied with a bias from a charging bias power source (not shown). In this example, a bias is applied to the charging roller 11 such that a dark potential Vd on the photosensitive drum 10 is −500 V. The photosensitive drum 10 is irradiated with laser from the scanner unit 13 on the basis of the image information, and an electrostatic latent image is formed on the charged photosensitive drum 10. In this example, laser is applied such that a bright potential Vd on the photosensitive drum 10 is −100 V. The cleaning member 12 is formed by molding polyurethane rubber on a metal support. The cleaning member 12 contacts with the photosensitive drum 10 in a counter direction of the rotation direction of the photosensitive drum 10.

In this example, the thickness of a metal support constituting the cleaning member 12 is 1.2 mm to 2.0 m, and the hardness of polyurethane rubber is 60° to 80° (Wallace hardness). Note that, as polyurethane rubber, a tip-cured blade obtained by curing only a part of polyurethane rubber that contacts with the photosensitive drum 10 may be used. The cleaning member 12 removes toner remaining on the photosensitive drum 10 after a toner image is transferred on the intermediate transfer belt 31 from the photosensitive drum 10. Toner removed by the cleaning member 12 is stored in the collection container 5 (storing container). The collection sheet member 4 prevents the stored toner from leaking to the outside of the collection container 5.

The developing unit D has a developing chamber E and a developer container F. In this example, the developer container F is disposed below the developing chamber E. In the developer container F, toner as a developer is stored.

In this example, an image forming operation when the regular charging polarity of toner is negative polarity and negative-charging toner is used is described below. Note that, in this example, toner used for image forming is not limited to negative-charging toner. A developer container F is provided with a toner transport member 24 for transporting toner in the developer container F to a developing chamber E. The toner transport member 24 rotates in the direction of arrow G in FIG. 2 to transport toner to the developing chamber E. The developing chamber E is provided with a developing roller 21 that rotates in the direction of arrow D when receiving driving power of a driving motor (not shown). The developing roller 21 rotates while being in contact with the photosensitive drum 10. In this example, the developing roller 21 and the photosensitive drum 10 rotate such that the developing roller 21 and the photosensitive drum 10 move in the same direction in a region where the developing roller 21 and the photosensitive drum 10 contact with each other.

In this example, the peripheral speed of the developing roller is set to be 145% of the peripheral speed of the photosensitive drum. The developing roller 21 is applied with a bias necessary for developing an electrostatic latent image on the photosensitive drum 10 from a developing bias power source (not shown). In this example, a developing bias of −350 V is applied to the developing roller 21. In the developing chamber E, a supply roller 22 configured to supply toner transported from the developer container F to the developing roller 21 and a regulating blade 23 configured to regulate the amount of toner on the developing roller 21 and apply charge to the toner on the developing roller 21 are disposed.

In this example. the developing roller 21 has a diameter ϕ15 mm, and is formed by covering a base layer, which is obtained by covering a conductive core having a diameter of ϕ6 mm with silicone rubber, with urethane resin. Note that a developing roller having a volume resistance of 104 to 1012Ω can be used as the developing roller 21. The supply roller 22 is a conductive elastic sponge roller having a diameter of ϕ15 mm formed by forming a foam layer on a conductive core having a diameter of ϕ6 mm.

A supply roller having a volume resistance of 104 to 108Ω can be used as the supply roller 22. In this example, the resistance value of the supply roller 22 is 4×106Ω, and the hardness of the supply roller 22 is 200 gf. Note that the hardness of the supply roller 22 in this example was determined by measuring load when a flat plate having a longitudinal length of 50 mm is caused to enter the surface of the supply roller 22 by 1 mm. The regulating blade 23 is a metal plate having a thickness of 0.1 mm, and contacts with the developing roller 21 in the counter direction of the rotation direction of the developing roller 21. Note that, in this example, the regulating blade 23 is formed by cutting a SUS (stainless steel) plate from the side where the regulating blade 23 contacts with the developing roller 21 to the side where the regulating blade 23 does not contact with the developing roller 21. The developing roller 21 and the supply roller 22 are applied with a developing bias from high voltage application unit (not shown). When the developing roller 21 rotates, toner supplied to the developing roller 21 by the supply roller 22 is transported to the position at which the regulating blade 23 contacts with the developing roller 21. In this manner, toner on the developing roller 21 is rubbed on the regulating blade 23 and triboelectrically charged, and the thickness of a toner layer on the developing roller 21 is adjusted. When the developing roller 21 rotates, the toner with the adjusted layer thickness on the developing roller 21 is transported to the photosensitive drum 10, and then, an electrostatic latent image on the photosensitive drum 10 is developed as a toner image.

<Developer>

Next, a developer used in the image forming apparatus 100 is described. The developer in this example is negative-charging toner that is non-magnetic single-component developer, and silica fine particles are externally added (added) to the periphery of the toner as an external additive. In this example, silica fine particles were externally added such that, when the weight of resin toner particles was 100 wt %, the rate of the external additive (percent by weight of external additive) was 0.5 wt % to 2.0 wt %. However, the developer is not limited thereto, and may be a magnetic or two-component developer. In this example, as toner, toner having a toner particle diameter of 5 to 9 μm in terms of median diameter (d50) can be used. Toner in which the particle diameter of an external additive is 10 to 300 nm can be used. As the external additive, in addition to silica fine particles, fine particles of titanium oxide, aluminum oxide, zinc oxide, cerium oxide, tin oxide, and strontium titanate can be used. As the toner, toner in which the degree of agglomeration is 5% to 50% in the initial state (state where developing unit B is unused) can be used.

Note that the degree of agglomeration of toner was measured as follows. As a measurement device, a powder tester (manufactured by Hosokawa Micron Corporation) having a digital vibration meter (DIGITAL VIBRATION METER MODEL 1332 manufactured by SHOWA SOKKI CORPORATION) was used. For measuring the degree of agglomeration of toner, sieves with a 390 mesh, a 200 mesh, and a 100 mesh were set on a vibrating stage in ascending order of mesh opening. Specifically, the 390-mesh sieve, the 200-mesh sieve, and the 100-mesh sieve were stacked in order such that the 100-mesh sieve was disposed at the top.

An accurately weighted 5-g sample (toner) was added onto the set 100-mesh sieve, and the vibrating stage was vibrated for 15 seconds in a manner that the displacement of the digital vibration meter was 0.60 mm (peak-to-peak). After that, the mass of the sample remaining on each sieve was measured to measure the degree of agglomeration on the basis of the following expression. As measurement samples, toner that was left for 24 hours under environments of a temperature of 23° and a relative humidity of 60% was used. The measurement was performed under environments of a temperature of 23° C. and a relative humidity of 60%. Note that the degree of agglomeration can be determined by the following expression.

Degree of agglomeration (%)=(mass of sample remaining on 100-mesh sieve/5 g)×100+(mass of sample remaining on 200-mesh sieve/5 g)×60+(mass of sample remaining on 390-mesh sieve/5 g)×20

<Printing Control at Printing Speed of 45 ppm>

In the following, the driving speeds and the driving timings of the photosensitive drum 10 and the developing roller 21 and the timings of contact and separation of the photosensitive drum 10 and the developing roller 21 at a printing speed of 45 ppm are mainly described.

Figure 3:
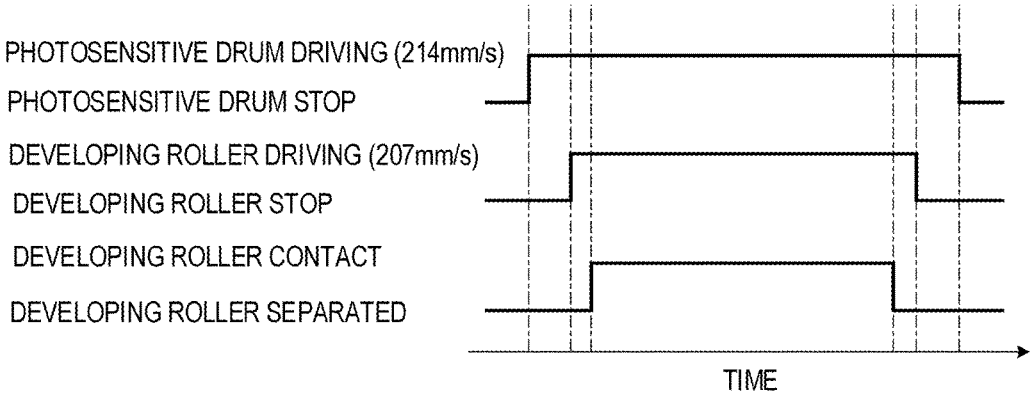
FIG. 3 is a control diagram of the image forming apparatus according to Example 1.

FIG. 3 is a diagram illustrating the driving speeds and the driving timings of the photosensitive drum 10 and the developing roller 21 and the timings of contact and separation of the photosensitive drum 10 and the developing roller 21 at a printing speed of 45 ppm. The driving speeds refer to the movement speeds (rotation speeds) of the surfaces of the photosensitive drum 10 and the developing roller 21 in the circumferential direction. When image information is transmitted to the image forming apparatus 100, image forming operation is started. First, the photosensitive drum 10 and the intermediate transfer belt 31 start to be driven simultaneously, and after the driving speeds of the photosensitive drum 10 and the intermediate transfer belt 31 are increased to 214 mm/s, the photosensitive drum 10 and the intermediate transfer belt 31 contact with each other. Next, the developing roller 21 starts to be driven, and after the driving speed is increased to 207 mm/s, the developing rollers 21 contact with the photosensitive drums 10 sequentially in the order from yellow to black. Image formation corresponding to image information is performed in a developer supply period after the contact of the developing roller 21 of black with the photosensitive drum 10 is completed.

Note that, in the above-mentioned image forming process, the photosensitive drum 10 contacts with the developing roller 21 after the photosensitive drum 10 and the developing roller 21 are both in the rotating state. The reason is as follows. The photosensitive drum 10 is first rotated, and the surface of the photosensitive drum is charged due to triboelectric charging with the charging roller 11. Unless the photosensitive drum 10 contacts with the developing roller 21 in this state, toner on the surface of the developing roller is not transferred to the photosensitive drum 10 and is scattered in the apparatus. Regarding the developing roller 21, as described above, the toner on the developing roller 21 is rubbed by the regulating blade 23 to be triboelectrically charged, and the thickness of the toner on the developing roller 21 is regulated. Charges of the toner on the developing roller 21 are controlled because the toner was rubbed by the regulating blade 23. Thus, if the developing roller 21 contacts with the photosensitive drum 10 in the state in which the developing roller 21 is not rotating, toner that is not regularly charged is transferred to the photosensitive drum 10. This is the reason why the developing roller 21 and the photosensitive drum 10 contact with each other after the developing roller 21 and the photosensitive drum 10 are both in the rotating state.

In the developer supply period, when each step of latent image formation, development, transfer, and fixing is finished, the recording medium is discharged from the image forming apparatus 100, and an operation to finish the image forming operation, which is a developer supply period, is started. First, the developing rollers 21 sequentially start to be separated from the photosensitive drums 10 in the order from yellow to black, and when the separation of the developing roller 21 of black is finished, the driving of the developing roller 21 is stopped. Next, the operation to separate the photosensitive drum 10 and the intermediate transfer belt 31 is started, and when the separation is finished, the driving of the photosensitive drum 10 and the intermediate transfer belt 31 is stopped, and the image forming operation is finished. Note that the developer supply period is a period during which the photosensitive drum 10 and the developing roller 21 are rotationally driven while contacting with each other, and does not refer to only a period during which image formation corresponding to image information is performed. For example, if jamming occurs during printing, it is necessary to rotationally drive the photosensitive drum 10 in order to remove a developer formed on the photosensitive drum 10 by the cleaning member 12. In the case where the photosensitive drum 10 and the developing roller 21 are rotationally driven while contacting with each other, this period also corresponds to the developer supply period.

<Printing Control for Suppressing Abnormal Noise in this Example>

Figure 4A:
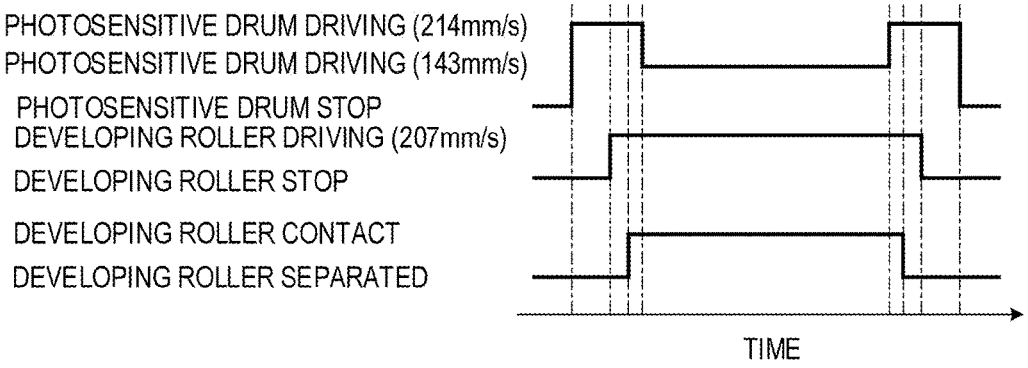
FIGS. 4A and 4B are control diagrams of the image forming apparatus according to Example 1.
Figure 4B:
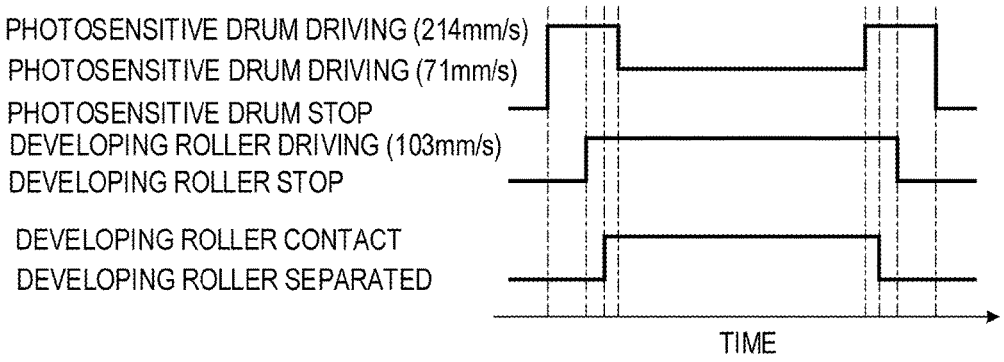

In the following, the driving speeds and the driving timings of the photosensitive drum 10 and the developing roller 21 and the timings of contact and separation of the photosensitive drum 10 and the developing roller 21 in this example are mainly described. FIGS. 4A and 4B are diagrams illustrating the driving speeds and the driving timings of the photosensitive drum 10 and the developing roller 21 and the timings of contact and separation of the photosensitive drum 10 and the developing roller 21 in this example.

First, a printing operation of the image forming apparatus 100 at a printing speed of 30 ppm is described with reference to FIG. 4A. When image information is transmitted to the image forming apparatus 100, the image forming operation is started. First, the photosensitive drum 10 and the intermediate transfer belt 31 start to be driven simultaneously, and after the driving speeds of the photosensitive drum 10 and the intermediate transfer belt 31 are increased to 214 mm/s, the photosensitive drum 10 and the intermediate transfer belt 31 contact with each other. Next, the developing roller 21 starts to be drive, and after the driving speed is increased to 207 mm/s, the developing rollers 21 sequentially contact with the photosensitive drums 10 in the order from yellow to black. After the contact of the developing roller 21 of black with the photosensitive drum 10 is completed, the peripheral speeds of the photosensitive drum 10 and the intermediate transfer belt 31 are decreased to 143 mm/s, and a developer supply period is started. In other words, the control unit 15 is configured to sequentially execute: (1) rotating the photosensitive drums 10 at 214 mm/s in the separated state, (2) switching from the separated state to the contact state when the photosensitive drums 10 rotates at 214 mm/s, and (3) rotating the photosensitive drums 10 by decreasing a rotation speed of the photosensitive drums 10 from 214 mmm/s to 143 mm/s in the contact state, in order to rotate the photosensitive drums 10 at 143 mm/s in the contact state. In the developer supply period in this example, image formation corresponding to image information is performed.

In the developer supply period, when each step of latent image formation, development, transfer, and fixing is finished, the recording medium is discharged from the image forming apparatus 100, and an operation to finish the image forming operation that is the developer supply period is started. First, after the driving speeds of the photosensitive drum 10 and the intermediate transfer belt 31 are increased to 214 mm/s, the developing rollers 21 sequentially start to be separated from the photosensitive drums 10 in the order from yellow to black. After that, when the separation of the developing roller 21 of black is finished, the driving of the developing roller 21 is stopped. Next, the operation to separate the photosensitive drum 10 and the intermediate transfer belt 31 is started, and when the separation is finished, the driving of the photosensitive drum 10 and the intermediate transfer belt 31 is stopped, and the image forming operation is finished.

Next, a printing operation of the image forming apparatus 100 at a printing speed of 15 ppm is described with reference to FIG. 4B. When image information is transmitted to the image forming apparatus 100, the image forming operation is started. First, the photosensitive drum 10 and the intermediate transfer belt 31 start to be driven simultaneously, and after the driving speeds of the photosensitive drum 10 and the intermediate transfer belt 31 are increased to 214 mm/s, the photosensitive drum 10 and the intermediate transfer belt 31 contact with each other. Next, the developing roller 21 starts to be drive, and after the driving speed is increased to 103 mm/s, the developing rollers 21 sequentially contact with the photosensitive drums 10 in the order from yellow to black. After the contact of the developing roller 21 of black with the photosensitive drum 10 is completed, the peripheral speeds of the photosensitive drum 10 and the intermediate transfer belt 31 are decreased to 71 mm/s, and the developer supply period is started. In other words, the control unit 15 is configured to sequentially execute: (1) rotating the photosensitive drum 10 at 214 mm/s in the separated state, (2) switching from the separated state to the contact state when the photosensitive drum 10 rotates at 214 mm/s, and (3) rotating the photosensitive drum 10 by decreasing a rotation speed of the photosensitive drum 10 from 214 mm/s to 71 mm/s in the contact state, in order to rotate the photosensitive drum 10 at 71 mm/s in the contact state.

In the developer supply period in this example, image formation corresponding to image information is performed. In the developer supply period, when each step of latent image formation, development, transfer, and fixing is finished, the recording medium is discharged from the image forming apparatus 100, and an operation to finish the image forming operation that is the developer supply period is started. First, after the driving speeds of the photosensitive drum 10 and the intermediate transfer belt 31 are increased to 214 mm/s, the developing rollers 21 sequentially start to be separated from the photosensitive drums 10 in the order from yellow to black. After that, when the separation of the developing roller 21 of black is finished, the driving of the developing roller 21 is stopped. Next, the operation to separate the photosensitive drum 10 and the intermediate transfer belt 31 is started, and when the separation is finished, the driving of the photosensitive drum 10 and the intermediate transfer belt 31 is stopped, and the image forming operation is finished. Note that, in the above-mentioned image forming process, the photosensitive drum 10 contacts with the developing roller 21 after both the photosensitive drum 10 and the developing roller 21 are in the rotating state. The reason is the same as in the case where the printing speed is 45 ppm.

<Printing Control According to a Comparative Example of This Example>

Figure 5A:
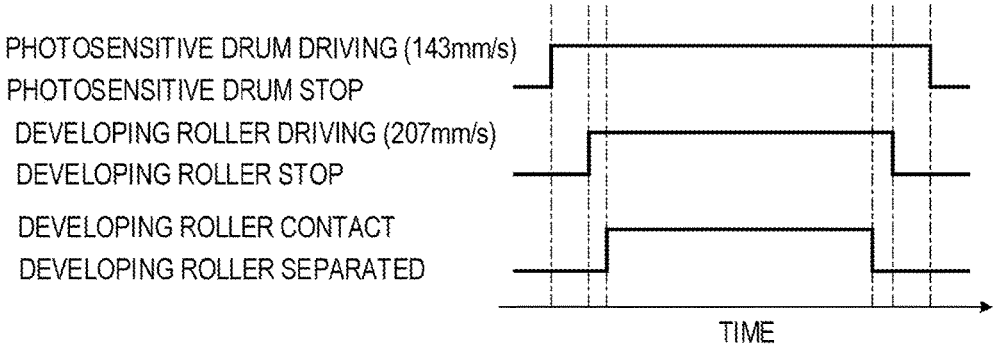
FIGS. 5A and 5B are control diagrams of an image forming apparatus according to a comparative example of Example 1.
Figure 5B:
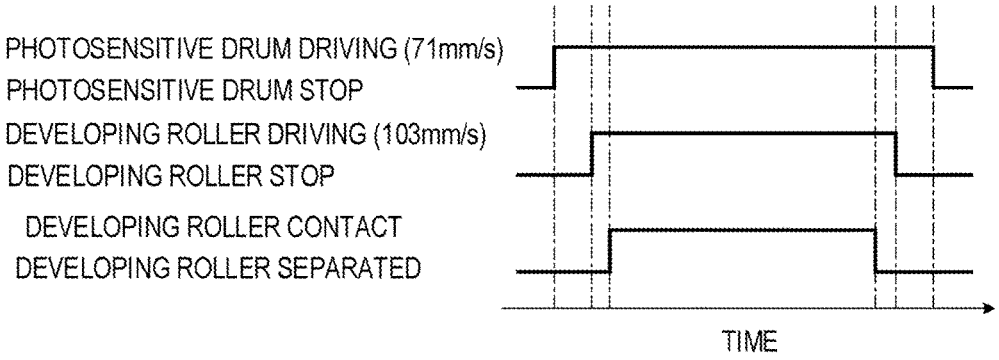

In the following, the driving speeds and the driving timings of the photosensitive drum 10 and the developing roller 21 and the timings of contact and separation of the photosensitive drum 10 and the developing roller 21 according to a comparative example of this example are mainly described. FIGS. 5A and 5B are diagrams illustrating the driving speeds and the driving timings of the photosensitive drum 10 and the developing roller 21 and the timings of contact and separation of the photosensitive drum 10 and the developing roller 21 in this comparative example.

First, a printing operation of the image forming apparatus 100 at a printing speed of 30 ppm is described with reference to FIG. 5A. When image information is transmitted to the image forming apparatus 100, the image forming operation is started. First, the photosensitive drum 10 and the intermediate transfer belt 31 start to be driven simultaneously, and after the driving speeds of the photosensitive drum 10 and the intermediate transfer belt 31 are increased to 143 mm/s, the photosensitive drum 10 and the intermediate transfer belt 31 contact with each other. Next, the developing roller 21 starts to be drive, and after the driving speed is increased to 207 mm/s the developing rollers 21 sequentially contact with the photosensitive drum 10 in the order from yellow to black, and image formation corresponding to image information is performed. When each step of latent image formation, development, transfer, and fixing is finished, the recording medium is discharged from the image forming apparatus 100, and an operation to finish the image forming operation is started. First, the developing rollers 21 sequentially start to be separated from the photosensitive drums 10 in the order from yellow to black, and when the separation of the developing roller 21 of black is finished, the driving of the developing roller 21 is stopped. Next, the operation to separate the photosensitive drum 10 and the intermediate transfer belt 31 is started, and when the separation is finished, the driving of the photosensitive drum 10 and the intermediate transfer belt 31 is stopped, and the image forming operation is finished.

Next, a printing operation of the image forming apparatus 100 at a printing speed of 15 ppm is described with reference to FIG. 5B. When image information is transmitted to the image forming apparatus 100, the image forming operation is started. First, the photosensitive drum 10 and the intermediate transfer belt 31 start to be driven simultaneously, and after the driving speeds of the photosensitive drum 10 and the intermediate transfer belt 31 are increased to 71 mm/s, the photosensitive drum 10 and the intermediate transfer belt 31 contact with each other. Next, the developing roller 21 starts to be drive, and after the driving speed is increased to 103 mm/s, the developing rollers 21 sequentially contact with the photosensitive drum 10 in the order from yellow to black, and image formation corresponding to image information is performed. When each step of latent image formation, development, transfer, and fixing is finished, the recording medium is discharged from the image forming apparatus 100, and an operation to finish the image forming operation is started. First, the developing rollers 21 sequentially start to be separated from the photosensitive drum 10 in the order from yellow to black, and when the separation of the developing roller 21 of black is finished, the driving of the developing roller 21 is stopped. Next, the separation operation of the photosensitive drum 10 and the intermediate transfer belt 31 is started, and when the separation is finished, the driving of the photosensitive drum 10 and the intermediate transfer belt 31 is stopped, and the image forming operation is finished. Note that the comparative example is different from this example in that the driving speed of the photosensitive drum 10 remains unchanged before and after the photosensitive drum 10 contacts with the developing roller and in the contact period.

<Experimental Results Indicating Effects of the Invention>

Next, experimental results indicating effects of Example are described. To verify the effect of reducing "abnormal noise" generated from the cleaning apparatus, the presence/absence of "abnormal noise" was observed by performing a two-print intermittent printing test where horizontal lines having an image aspect of 1% were printed on 20,000 sheets under environments of a temperature of 23° C. and a relative humidity of 50% for each printing speed. The presence/absence of abnormal noise was observed at positions away from the image forming apparatus by given distances (30 cm, 1 m, 3 m). In the following table, O indicates that no auditory abnormal noise was generated. X indicates that auditory abnormal noise was generated.

TABLE 1

| | | Distance from image forming apparatus | | |
|---|---|---|---|---|
| | Printing speed | 30 cm | 1 m | 3 m |
| Example 1 | 45 ppm | ○ | ○ | ○ |
| | 30 ppm | ○ | ○ | ○ |
| | 15 ppm | ○ | ○ | ○ |
| Comparative Example | 30 ppm | X | ○ | ○ |
| | 15 ppm | X | X | ○ |

As illustrated in Table 1, when the driving speeds and the driving timings of the photosensitive drum 10 and the developing roller 21 and the timings of contact and separation of the photosensitive drum 10 and the developing roller 21 were controlled as in Example 1, the generation of auditory abnormal noise was not observed even at a distance of 30 cm from the image forming apparatus. On the other hand, when the driving speeds and the driving timings of the photosensitive drum 10 and the developing roller 21 and the timings of contact and separation are controlled as in the comparative example, at a printing speed of 30 ppm, the generation of auditory abnormal noise was not observed at a distance of 1 m from the image forming apparatus. At a distance of 30 cm from the image forming apparatus, however, the generation of auditory abnormal noise was observed. At a printing speed of 15 ppm, the generation of auditory abnormal noise was not observed at a distance of 3 m from the image forming apparatus, but the generation of auditory abnormal noise was observed at a distance of 1 m from the image forming apparatus.

Abnormal noise caused due to vibration of the cleaning member 12 is generated in many cases when only the photosensitive drum 10 is driven in the state in which the developing roller 21 is separated from the photosensitive drum 10. This is because when the photosensitive drum 10 is driven in the state in which the developing roller 21 and the photosensitive drum 10 contact with each other, fogging toner is supplied to the cleaning member 12 to prevent the increase of the friction coefficient μ of the photosensitive drum 10. When the photosensitive drum 10 is driven in the state in which the developing roller 21 and the photosensitive drum 10 are separated from each other, fogging toner is not supplied to the cleaning member 12. As a result, the friction coefficient of the photosensitive drum 10 increases and the cleaning member 12 vibrates, and the vibration of the cleaning member 12 is transferred to the container in the image forming apparatus and resonates with the natural frequency of the container itself. Thus, abnormal noise is generated.

Next, functions and effects of Example 1 are described. Vibration of the cleaning member 12 occurs when the surface friction coefficient μ of the photosensitive drum 10 increases so that the cleaning member 12 stick-slips, and the vibration of the cleaning member 12 is transferred to the collection container. The stick-slip is less liable to occur when the peripheral speed of the photosensitive drum 10 is higher. This is because in the case where the peripheral speed of the photosensitive drum 10 is high, when the cleaning member 12 gets caught and slips to try to return to its original position, the cleaning member 12 get caught by the photosensitive drum 10 again to prevent the stick-slip from easily occurring.

As described above, in this example, two kinds of the movement speed (rotation speed) of the image bearing member are set: a first speed that is the movement speed of the image bearing member before and after the developer supply period; and a second speed that is the movement speed of the image bearing member in the developer supply period. Specifically, 214 mm/s described above corresponds to the first speed, and 143 mm/s in the case of a printing speed of 30 ppm and 71 mm/s in the case of a printing speed of 15 ppm correspond to the second speed. The mode in which the first speed for bringing the developer carrying member into contact with the image bearing member during the image forming operation for supplying a developer from the developer carrying member to the image bearing member is set to be higher than the second speed is provided to enable the stick-slip of the cleaning member 12 to be suppressed. As a result, the vibration of the collection container was able to be suppressed to reduce the generation of abnormal noise. Note that, in this example, it is more preferred that the range of the rotation speed of the image bearing member that does not generate abnormal noise be at least 150 mm/s and be not more than 400 mm/s as the upper limit with reference to 214 mm/s described above. If the speed is excessively increased, abnormal noise of a motor configured to rotate the image bearing member may be generated. Note that, in this example, the movement speed (first speed) of the image bearing member in both the contact period during which the developer carrying member is brought into contact with the image bearing member and the separation period during which the developer carrying member is separated from the image bearing member, which are before and after the developer supply period, is set to be higher than the movement speed (second speed) of the image bearing member in the developer supply period. However, the setting is not limited thereto. For example, only the movement speed of the image bearing member in the contact period during which the developer carrying member is brought into contact with the image bearing member before the developer supply period may be set to be higher than the movement speed of the image bearing member in the developer supply period. Alternatively, only the movement speed of the image bearing member in the separation period during which the developer carrying member is separated from the image bearing member after the developer supply period may be set to be higher than the movement speed of the image bearing member in the developer supply period.

In this example, the first speed for supplying a developer from the developer carrying member to the image bearing member is set to be equal to the movement speed of the image bearing member at a printing speed of 45 ppm. However, the setting is not limited thereto, and any rotation speed that prevents the stick-slip of the cleaning member 12 from easily occurring can be set for the image bearing member.

EXAMPLE 2

In Example 1, a description is given of the movement speed of the image bearing member before and after the developer supply period during which the developer carrying member is brought into contact with the image bearing member in order to supply a developer from the developer carrying member to the image bearing member in the case where image information is transmitted to the image forming apparatus and the image forming operation is performed. This example, however, has a feature that the movement speed of the image bearing member before and after the developer supply period during an operation other than the image formation is set to be higher than that in the developer supply period. Examples of the operation other than image formation include an operation for supplying a developer in order to reduce friction force between the cleaning member 12 and the photosensitive drum 10. Other various kinds of developer supply operations that are not intended to form images on recording material are included in operations other than the image formation. Note that, in the description of this example, descriptions of parts overlapping with those in Example 1 described above are omitted.

In this example, after the image forming operation is finished, toner is supplied from the developing roller (developer carrying member) 21 to the photosensitive drum (image bearing member) 10. In the toner supply sequence, the movement speed of the image bearing member before and after the developer supply period during which the developer carrying member is brought into contact with the image bearing member is set to be higher than the movement speed of the image bearing member in the developer supply period, thereby enabling the stick-slip of the cleaning member 12 to be suppressed. As a result, the vibration of the collection container can be suppressed to reduce the generation of abnormal noise. The reason why toner is suppled from the developing roller to the image bearing member in operations other than the image forming operation is to suppress the fixation of toner on the developing roller. The fixation of toner occurs when images having low print percentage are continuously printed or when the amount of consumption of toner on the developing roller is small and toner on the developing roller is not frequently replaced. To suppress the fixation of toner onto the developing roller, toner on the developing roller is forcibly supplied to the image bearing member each time a given number of sheets are printed. In this example, the above-mentioned control is implemented each time 300 sheets are printed. The reason why toner is supplied when the rotation speeds of the image bearing member and the developing roller correspond to a printing speed of 15 ppm is that a large amount of toner is sent at once and hence toner on the image bearing member needs to be removed at rotation speeds suited for cleaning.

<Control for Suppressing Abnormal Noise in Toner Supply Sequence in This Example>

In this example, a toner supply sequence is performed when the rotation speeds of the photosensitive drum 10 and the developing roller 21 correspond to a printing speed of 15 ppm. The rotation speed of the photosensitive drum 10 before and after the above-mentioned developer supply period is set to 214 mm/s.

Figure 6:
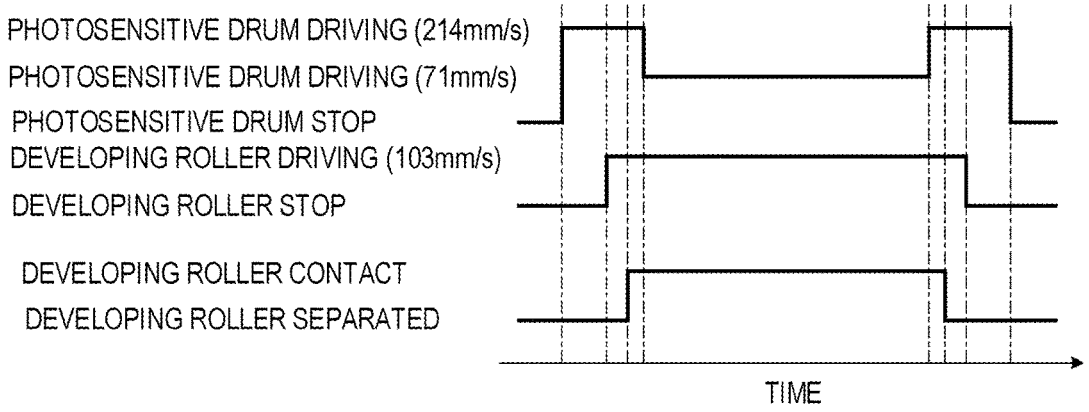
FIG. 6 is a control diagram of an image forming apparatus according to Example 2.

In the following, driving speeds and driving timings of the photosensitive drum 10 and the developing roller 21 and timings of contact and separation of the photosensitive drum 10 and the developing roller 21 in this example are mainly described. FIG. 6 is a diagram illustrating the driving speeds and the driving timings of the photosensitive drum 10 and the developing roller 21 and the timings of contact and separation of the photosensitive drum 10 and the developing roller 21 in this example.

When the number of printed sheets reaches the number of printed sheets for which the toner supply sequence is implemented, that is, 300 sheets, is reached, the image forming operation is suspended. The photosensitive drum 10 starts to be driven, and after the driving speed of the photosensitive drum 10 is increased to 214 mm/s, the developing roller 21 starts to be driven, and after the driving speed is increased to 103 mm/s, the developing rollers 21 sequentially contact with the photosensitive drums 10 in the order from yellow to black. After the contact of the developing roller 21 of black with the photosensitive drum 10 is completed, the driving speed of the photosensitive drum 10 is decreased to 71 mm/s, and a developer supply period is started. In the developer supply period in this example, a toner supply sequence is implemented. In the toner supply sequence, the photosensitive drum is irradiated with laser from the scanner unit to form an electrostatic latent image on the photosensitive drum 10 (image bearing member). The irradiation width of laser is set to the entire longitudinal region corresponding to one turn of the developing roller. The toner image formed on the photosensitive drum is transported to the cleaning member, and toner removed by the cleaning member 12 is stored in the collection container 5 (storing container).

In the developer supply period, when the toner supply sequence is finished, an operation to finish the toner supply sequence is started. First, after the driving speed of the photosensitive drum 10 is increased to 214 mm/s, the developing rollers 21 sequentially start to be separated from the photosensitive drums 10 in the order from yellow to black, and when the separation operation of the developing roller 21 of black is finished, the driving of the developing roller 21 is stopped. Next, the driving of the photosensitive drum 10 is stopped, and the toner supply sequence is finished. Then, the next image formation is ready to perform. In other words, the control unit 15 is configured to sequentially execute: (1) rotating, when the photosensitive drum 10 is rotated at 71 mm/s in the contact state, the photosensitive drum 10 at 214 mm/s by implementing switching from 71 mm/s to 214 mm/s in the contact state, and (2) switching from the contact state to the separated state when the photosensitive drum 10 rotates at 214 mails in the contact state, in order to switch from the contact state to the separated state when the photosensitive drums 10 is rotated at 71 mm/s.

<Toner Supply Sequence Control According to Comparative Example of this Example>

In the following, driving speeds and driving timings of the photosensitive drum 10 and the developing roller 21 and timings of contact and separation of the photosensitive drum 10 and the developing roller 21 according to a comparative example of this example are mainly described. In the comparative example, a toner supply sequence is performed when the rotation speeds of the photosensitive drum 10 and the developing roller 21 correspond to a printing speed of 15 ppm. The rotation speed of the photosensitive drum 10 before and after the above-mentioned developer supply period is also set to be equal to a printing speed of 15 ppm.

Figure 7:
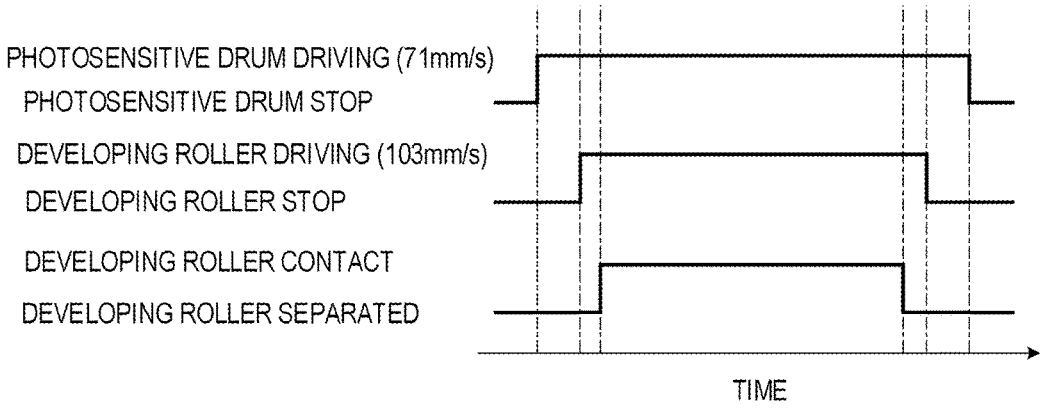
FIG. 7 is a control diagram of an image forming apparatus according to a comparative example of Example 2.

FIG. 7 is a diagram illustrating the driving speeds and the driving timings of the photosensitive drum 10 and the developing roller 21 and timings of contact and separation of the photosensitive drum 10 and the developing roller 21 in this comparative example. When the number of printed sheets for which the toner supply sequence is implemented is reached, the image forming operation is suspended. The photosensitive drum 10 starts to be driven, and after the driving speed of the photosensitive drum 10 is increased to 71 mm/s, the developing roller 21 starts to be driven. After the driving speed is increased to 103 mm/s the developing rollers 21 sequentially contact with the photosensitive drums 10 in the order from yellow to black. When the contact of the developing roller 21 of black with the photosensitive drum 10 is completed, a developer supply period is started.

In the developer supply period in this comparative example, a toner supply sequence is implemented. In the toner supply sequence, the photosensitive drum is irradiated with laser from the scanner unit to form an electrostatic latent image on the photosensitive drum 10 (image bearing member). The irradiation width of laser is set to the entire longitudinal region corresponding to one turn of the developing roller. The toner image formed on the photosensitive drum is transported to the cleaning member, and toner removed by the cleaning member 12 is collected in the collection container 5 (storing container). In the developer supply period, when the toner supply sequence is finished, an operation to finish the toner supply sequence is started. First, the developing rollers 21 sequentially start to be separated from the photosensitive drums 10 in the order from yellow to black, and when the separation of the developing roller 21 of black is finished, the driving of the developing roller 21 is stopped. Next, the driving of the photosensitive drum 10 is stopped, and the toner supply sequence is finished. Then, the next image formation is ready to perform.

<Experimental Results Indicating Effects of Invention>

Next, experimental results indicating effects of Example are described. To verify the effect of reducing "abnormal noise" generated from the cleaning apparatus, the presence/absence of "abnormal noise" in the toner supply sequence was observed by performing a two-print intermittent printing test where horizontal lines having an image aspect of 1% were printed on 20,000 sheets under environments of a temperature of 23° C. and a relative humidity of 50%. The presence/absence of abnormal noise was observed at positions away from the image forming apparatus by given distances (30 cm, 1 m, 3 m). In the following table, O indicates that no auditory abnormal noise was generated. X indicates that auditory abnormal noise was generated.

TABLE 2

| | Distance from image forming apparatus | | |
|---|---|---|---|
| | 30 cm | 1 m | 3 m |
| Example 2 | ○ | ○ | ○ |
| Comparative Example | X | X | ○ |

As illustrated in Table 2, in Example 2, the driving speeds and the driving timings of the photosensitive drum 10 and the developing roller 21 and the timings of contact and separation of the photosensitive drum 10 and the developing roller 21 were controlled as described above. As a result, the generation of auditory abnormal noise was not observed even at a distance of 30 cm from the image forming apparatus. On the other hand, when the driving speeds and the driving timings of the photosensitive drum 10 and the developing roller 21 and the timings of contact and separation are controlled as in the comparative example, the generation of auditory abnormal noise was not observed at a distance of 3 m from the image forming apparatus. At distances of 30 cm and 1 m from the image forming apparatus, however, the generation of auditory abnormal noise was observed.

As described above, in this example, unlike Example 1, the movement speed of the image bearing member in the developer supply period is set to the first speed, and the movement speed of the image bearing member before and after the developer supply period is set to the second speed. The mode in which the second speed for bringing the developer carrying member into contact with the image bearing member in an operation other than the image formation for supplying a developer from the developer carrying member to the image bearing member is set to be higher than the first speed is provided to enable the stick-slip of the cleaning member 12 to be suppressed. As a result, the vibration of the collection container can be suppressed to reduce the generation of abnormal noise. Note that, in this example, it is more preferred that the range of the rotation speed of the image bearing member that does not generate abnormal noise be at least 150 mm/s and be not more than 400 mm/s as the upper limit with reference to 214 mm/s described above. If the speed is excessively increased, abnormal noise of a motor configured to rotate the image bearing member may be generated.

Note that, in this example, the movement speed (second speed) of the image bearing member before and after the timing at which the toner is supplied from the developer carrying member to the image bearing member, which is the developer supply period, is set to be higher than the movement speed (first speed) of the image bearing member at the toner supply timing. However, the setting is not limited thereto, for example, only the movement speed of the image bearing member before the toner supply timing or only the movement speed of the image bearing member after the toner supply may be set to be higher than the movement speed of the image bearing member during the image forming operation.

Note that, in this example, the movement speed (second speed) of the image bearing member in both the contact period during which the developer carrying member is brought into contact with the image bearing member and the separation period during which the developer carrying member is separated from the image bearing member, which are before and after the developer supply period, is set to be higher than the movement speed (first speed) of the image bearing member in the developer supply period. However, the setting is not limited thereto. For example, only the movement speed of the image bearing member before the developer supply period or the movement speed of the image bearing member only in the separation period during which the developer carrying member is separated from the image bearing member after the developer supply period may be set to be higher than the movement speed of the image bearing member in the developer supply period.

In this example, the first speed for supplying a developer from the developer carrying member to the image bearing member is set to be equal to the movement speed of the image bearing member at a printing speed of 45 ppm. However, the setting is not limited thereto, and any rotation speed that prevents the stick-slip of the cleaning member 12 from easily occurring can be set for the image bearing member.

Note that, in FIGS. 4 to 7 in Examples 1 and 2, the rotation speeds of the photosensitive drum 10 and the developing roller 21 are abruptly changed when the state changes from the contact state to the separated state or when the state changes from the separated state to the contact state, but in practice, a transient period of a certain length is provided when the speed is changed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-190400, filed on Sep. 29, 2017, which is hereby incorporated by reference herein in its entirety.

What is claimed is:

1. An image forming apparatus, comprising:

an image bearing member for bearing an electrostatic latent image;

a developer carrying member, configured to carry a developer for developing the electrostatic latent image on the image bearing member and configured to be able to take a contact state in which the developer carrying member contacts with the image bearing member and a separated state in which the developer carrying member is separated from the image bearing member;

a control unit configured to control the image bearing member and the developer carrying member; and a contact member disposed in contact with a surface of the image bearing member, wherein the control unit is configured to sequentially execute:

(1 ) rotating the image bearing member at a first speed in the separated state;

(2 ) switching from the separated state to the contact state when the image bearing member rotates at the first speed; and (3 ) rotating the image bearing member by decreasing a rotation speed of the image bearing member from the first speed to a second speed smaller than the first speed in the contact state, in order to rotate the image bearing member at the second speed in the contact state.

2. The image forming apparatus according to claim 1, wherein the control unit is configured to switch from the separated state to the contact state after the developer carrying member becomes to rotate at a predetermined speed.

3. The image forming apparatus according to claim 1, wherein the contact state and the separated state are switched over therebetween when the image bearing member and the developer carrying member are each rotated at a given speed.

4. The image forming apparatus according to claim 1, wherein the second speed is a speed set for supplying the developer carried by the developer carrying member to the image bearing member.

5. The image forming apparatus according to claim 1, wherein the contact state and the separated state are switched over therebetween during an operation other than image formation.

6. The image forming apparatus according to claim 1, wherein the contact member is a cleaning member configured to clean a surface of the image bearing member.

7. The image forming apparatus according to claim 1, wherein the image bearing member has a rotation speed in a range of at least 150 mm/s and not more than 400 mm/s.

8. The image forming apparatus according to claim 1, wherein the image forming apparatus further comprises a contact/separation mechanism configured to switch between the contact state and the separated state, and wherein the contact/separation mechanism is controlled by the control unit.

9. The image forming apparatus according to 8, wherein the contact/separation mechanism is configured to switch between the contact state and the separated state by moving the developer bearing member.

10. An image forming apparatus, comprising:

an image bearing member for bearing an electrostatic latent image;

a developer carrying member configured to carry a developer for developing the electrostatic latent image on the image bearing member and configured to be able to take a contact state in which the developer carrying member contacts with the image bearing member and a separated state in which the developer carrying member is separated from the image bearing member;

a control unit configured to control the image bearing member and the developer carrying member; and a contact member disposed in contact with a surface of the image bearing member, wherein the control unit is configured to sequentially execute:

(1) rotating, when the image bearing member is rotated at a first speed in the contact state, the image bearing member at a second speed higher than the first speed by implementing switching from the first speed to the second speed in the contact state; and (2) switching from the contact state to the separated state when the image bearing member rotates at the second speed in the contact state, in order to switch from the contact state to the separated state when the image bearing member is rotated at the first speed.

11. The image forming apparatus according to claim 10, wherein the control unit is configured to switch from the contact state to the separated state when the developer carrying member is rotated at a predetermined speed.

12. The image forming apparatus according to claim 10, wherein the contact state and the separated state are switched over therebetween when the image bearing member and the developer carrying member are each rotated at a given speed.

13. The image forming apparatus according to claim 10, wherein the first speed is a speed set for supplying the developer carried by the developer carrying member to the image bearing member.

14. The image forming apparatus according to claim 10, wherein the contact state and the separated state are switched over therebetween during an operation other than image formation.

15. The image forming apparatus according to claim 10, wherein the contact member is a cleaning member configured to clean a surface of the image bearing member.

16. The image forming apparatus according to claim 10, wherein the image bearing member has a rotation speed in a range of at least 150 mm/s and not more than 400 mm/s.

17. The image forming apparatus according to claim 10, wherein the image forming apparatus further comprises a contact/separation mechanism configured to switch between the contact state and the separated state, and wherein the contact/separation mechanism is controlled by the control unit.

18. The image forming apparatus according to 17, wherein the contact/separation mechanism is configured to switch between the contact state and the separated state by moving the developer bearing member.

* * * * *